US008308026B2

(12) United States Patent
Rapko et al.

(10) Patent No.: US 8,308,026 B2
(45) Date of Patent: Nov. 13, 2012

(54) METHOD AND APPARATUS FOR PICKING UP, HOLDING AND DISPENSING OBJECTS

(75) Inventors: Darin Rapko, Castaic, CA (US); Norma Rapko, Castaic, CA (US)

(73) Assignee: Rapko Corporation, Castaic, CA (US)

( * ) Notice: Subject to any disclaimer, the term of this patent is extended or adjusted under 35 U.S.C. 154(b) by 633 days.

(21) Appl. No.: 12/488,584

(22) Filed: Jun. 21, 2009

(65) Prior Publication Data

US 2009/0314795 A1 Dec. 24, 2009

Related U.S. Application Data

(60) Provisional application No. 61/075,000, filed on Jun. 23, 2008.

(51) Int. Cl.
*B65H 3/00* (2006.01)

(52) U.S. Cl. ..... 221/267; 221/251; 221/260; 221/197; 221/198; 221/567; 221/281; 221/279; 221/306; 221/307; 221/185; 221/244; 221/268; 221/271; 221/297; 206/37; 206/537; 401/66

(58) Field of Classification Search ..... 221/251, 221/260, 197, 567, 281, 279, 306, 307, 267, 221/185, 244, 268, 271, 297, 198; 206/37, 206/537; 401/66
See application file for complete search history.

(56) References Cited

U.S. PATENT DOCUMENTS 1,940,321 A * 12/1933 Pagett ..... 473/137
2,718,299 A * 9/1955 Atwater et al. ..... 206/537
2,893,599 A * 7/1959 Kay ..... 221/260
3,612,348 A * 10/1971 Thomas ..... 221/2
3,612,349 A * 10/1971 Thomas ..... 221/4
3,757,781 A * 9/1973 Smart ..... 604/59
3,854,625 A * 12/1974 Kuebler ..... 221/198
3,934,584 A * 1/1976 Corio ..... 604/59
4,073,530 A 2/1978 Seidler
4,113,143 A * 9/1978 Spagnola, Jr. ..... 221/267
4,174,048 A * 11/1979 Volpe, Jr. ..... 221/267
4,359,240 A 11/1982 Woeber
4,424,923 A * 1/1984 Bingham ..... 224/251
4,742,936 A * 5/1988 Rein ..... 221/5
4,749,106 A * 6/1988 von Schuckmann et al. ... 222/96
4,770,454 A 9/1988 Muscher et al.
4,798,319 A * 1/1989 James, Jr. ..... 224/251
4,846,793 A * 7/1989 Leonard et al. ..... 604/62
4,944,120 A 7/1990 Weisman et al.

(Continued)

FOREIGN PATENT DOCUMENTS

CH 687 861 A5 3/1997

*Primary Examiner* — Gene O. Crawford
*Assistant Examiner* — Rakesh Kumar
(74) *Attorney, Agent, or Firm* — Edwin A. Sisson, Attorney at Law, LLC

(57) ABSTRACT

An apparatus for picking up, holding and dispensing objects is disclosed. The apparatus has a storing device, a holding device, a retaining device, and an ejection device that enables pick up, holding and dispensing of a plurality of objects. The apparatus provides an improved method of picking up, holding and storing objects that heretofore required extreme dexterity and substantial periods of time. The apparatus can be used to pick up, hold and dispense a variety of objects including, but not limited to, crystals, nuts, confectionary pieces, pills, jewelry, and electronic components. The apparatus may be sold as a kit or as replacement parts.

14 Claims, 4 Drawing Sheets

U.S. PATENT DOCUMENTS

| | | | | | |
|---|---|---|---|---|---|
| 4,955,162 | A | | 9/1990 | Jackson | |
| 5,054,649 | A | * | 10/1991 | Lemaire et al. | 221/248 |
| 5,067,633 | A | * | 11/1991 | Grosz et al. | 221/279 |
| 5,121,956 | A | | 6/1992 | Horkey | |
| 5,395,106 | A | * | 3/1995 | Tohnai et al. | 271/258.04 |
| 5,395,146 | A | * | 3/1995 | Liu et al. | 294/19.2 |
| 5,810,198 | A | | 9/1998 | Townsend et al. | |
| 5,839,605 | A | * | 11/1998 | Hadtke et al. | 221/59 |
| 6,263,562 | B1 | * | 7/2001 | Gosis et al. | 29/809 |
| 6,772,908 | B2 | * | 8/2004 | Roethel et al. | 221/279 |
| 7,204,391 | B2 | * | 4/2007 | Toker | 221/226 |
| 7,273,158 | B1 | * | 9/2007 | Dean | 221/270 |
| 7,302,745 | B2 | * | 12/2007 | Stahle | 29/434 |
| 7,494,296 | B2 | * | 2/2009 | Stahle | 403/109.5 |
| 7,900,798 | B1 | * | 3/2011 | Allen | 221/307 |
| 8,062,248 | B2 | * | 11/2011 | Kindel | 604/63 |
| 2007/0170202 | A1 | * | 7/2007 | Chen et al. | 221/267 |

* cited by examiner

METHOD AND APPARATUS FOR PICKING UP, HOLDING AND DISPENSING OBJECTS

PRIORITIES AND CROSS REFERENCES

This application claims priority from U.S. Provisional Application 61/075,000 filed on Jun. 23, 2008, the embodiments, examples, and claims of which are incorporated by reference.

FIELD OF INVENTION

This invention relates to a method and apparatus for picking up, holding and dispensing objects.

BACKGROUND

Small or generally difficult to manipulate objects and objects which can be contaminated by touch are generally picked up and manipulated using tweezers and vacuum pick-up devices. Especially with respect to objects that are easily damaged, tweezers have been found less than satisfactory although in wide use. With extremely small objects which are very thin, tweezers have proven most unsatisfactory.

The tweezers and other object holders in common use are not satisfactory as the holder is so large. Some holders which do not securely hold an object risk accidental dropping of the object, resulting in their damage and loss. U.S. Pat. No. 1,001,991 describes an object holding device using claws to hold the object. This apparatus is unwieldy and so complex as to be cumbersome.

Various holding devices having an elongated handle with a wire array to hold objects have previously been invented, some being U.S. Pat. No. 3,743,338, U.S. Pat. No. 2,116,651, and British Patent No. 2791, issued Dec. 24, 1902. However, these patents describe a golf ball retriever, fruit grasping tongs, and a ping pong ball retriever and would be unsuitable as a holder for smaller objects.

A number of pick-up grippers or pipettes have already been suggested, which generally consist of a holding head with a holding shaft, whereby the individual objects are suctioned up to a suction opening in the holding head via a suction line, transferred in this manner, and deposited on a surface.

The devices facilitate a simple pick-up of the individual components and generally also a faultless deposit of the object on a surface at the location desired in each case. However, in some executions, the source of negative pressure, which is generally connected via a connecting hose through the gripper part to the holding head and its exit opening, is switched on and off by means of a pedal switch. Thereby, movements of hand and feet must be precisely coordinated, and since the deposit of a miniature object onto a surface requires extreme concentration, the operator is disturbed by the additional foot movement, which also easily causes a jarring movement, whereby the component might in some cases be dislocated precisely at that moment when it should be deposited. Increase and decrease of negative pressure in this type of manual equipment are also too slow for many purposes. Furthermore, this type of device is too costly and complicated for consumers attempting to use this type of device in their home.

Holding devices for the abovementioned components have also become known, in which the increase and decrease of pressure is initiated via a switch in the handle or an air escape opening which is opened and closed by the operator. This also causes the disadvantage that additional jarring movements may occur due to the activation of a switch in the shaft and render a correct deposit of the small objects more difficult.

In addition, it should be noted that the spatial assignments between objects and target surface may require orientations that deviate from one another by as much as 180.degrees. Thereby, the operator must also grasp the holding handle in a different way, or turn the hand, which can make the activation of a switch in the handle extremely difficult.

People with unsteady hands or limited control of their fingers often encounter significant difficulties in gripping small objects with their fingers, such as picking up a pill or a paper clip with their finger tips. Similar difficulties are experienced by people who have restricted mobility of their fingers caused by symptomatic joints, such as inflammation, arthritis, or the like. For those people with limited hand/finger dexterity, a hand-held gripping device that allows the person to pick up small objects with relative ease is clearly desirable. Conventional hand-held gripping devices (such as tweezers, needle nose pliers or the like) for handling small objects are not suitable for such use due to the hand dexterity required to operate them.

Some hand-held gripping devices proposed in the past use a pair of relatively wide side members which are hinged or otherwise connected so that the two side members can be pivoted towards each other to grip an object or to scoop the object up with the edges of the side members. Such devices can be seen, for example, in U.S. Pat. No. 3,975,043 and U.S. Pat. No. 4,188,055. These devices are designed for handling relatively large objects, such as animal excrement or fish, and are generally unsuitable for the purpose of handling small objects. Their relative large sizes also make them difficult to operate by a person with restricted finger control or mobility. Another problem with those gripping devices with two pivotable side members is that such a device does not reliably retain a small object scooped up by the edges of the side members. Typically, the two side members of such a gripping device form two side openings when their respective edges engage each other. Thus, a small object scooped up by the edges may escape from the gripping device through the side openings during subsequent handling by the user. This problem is especially significant for people with unsteady hands.

Turning now from apparatuses used for picking up objects to those used for dispensing objects, the existence of pill or tablet dispensers in the market is not entirely new, as different, ingenious forms or presentations of these dispensers have been known for a long time. A common dispenser consists of two parts, the first being a cap which has in the inside a series of channels with two side slots, and the second a base with two projections which are prolonged upward on the upper end, which are coupled inside the side slots of the cap and slide between the channels forward or backward, thus showing an opposite opening in each case, and in both cases, upon tilting the device, allowing the immediate exit of almost all the pills placed inside the base. This device has the disadvantage that when used, a plurality of the contents is quickly released, as it is impossible to control the exit of the product; furthermore, this dispenser has the inconvenience of being rather bulky.

In another presentation of the prior art, there is a rounded, rectangular container formed by two pieces, one of which forms the container itself, which in turn consists of two lids, an upper and a lower one, wherein the upper one in addition to having a peripheral flange, has a circular orifice on one side, and in the middle part, an elongated rectangular opening through which a sliding piece is introduced. The sliding piece has a projection on the lower part which connects under pressure by the rectangular opening, and moves through it forward or backward by the finger of the user, closing or opening the circular orifice, thus causing the product from inside the container to exit or not through the orifice when the container is abruptly turned upside down. However, if this motion is made carefully, tilting the container almost horizontally, the product can exit one by one. The main defect of this device is that if it is not carefully handled, a plurality of tablets exit indiscriminately from the inside, and therefore they have to be put back in by hand, something which for hygienic reasons is not a commendable operation.

In another embodiment, there is a small, flat, rectangular container formed by two molded plastic pieces. The lower plastic piece serves as a receptacle, and includes a peripherally arranged short flange, slightly toward the outside, with a dividing zone inside with an arched projection on one side, which serves as a guide for the pills, and which widens progressively toward one of the corners to cause the exit of the product. The upper plastic piece serves as a lid with an almost totally internal edge, interrupted only on one side of its ends, and which has a series of notches inside which connect with the container flange and which allow it to slide in on only one end, thus allowing the exit of one or several pills during each use of the device. The defect of this dispensing device is that it constantly breaks the product, with part of the product remaining inside, and therefore the entire product is not used; for this reason its use is neither convenient nor commendable.

Another of the dispensers known in the prior art is that formed of an elongated, bulky container with slightly arched shapes with a sufficient extension to be secured inside the hand. This device consists of three pieces, one of which serves as a container or support, and which has a hollow lower part through which the product will exit from the inside; it also has a cavity inside which narrows downward and which limits the exit of the product; and lastly, in its lower part it has a small horizontal, rectangular channel. The second piece is an upper lid through which the contents of the dispenser are filled or emptied, and the third piece is a slightly arched side piece which acts as a trigger or activating lever, and which is a shaft structure with projections prolonged forward that are used as a support and a perforated, perpendicular tongue through which fits only one of the pills from the inside, and which has a projection at the end to fix it adequately and avoid its coming off. Although this device produces the individual exit of the tablets, its main defect is that it frequently breaks the pills when used, and as its closure is inadequate, loose portions of the broken product continuously exit through the interstices of the container, producing an undesirable effect.

U.S. Pat. No. 4,171,753 shows a pill dispenser having a spring loaded inner pill cartridge inside a tubular outer housing. A dispensing lid is threaded atop the outer tube. Reloading this holder is difficult as the pills must be inserted through the bottom of the pill cartridge and pushed upward. Moreover, the pills tend to pop out of the inner tube as the spring pushes the pills upward toward the dispensing opening.

U.S. Pat. Nos. 1,671,285; 4,295,579; and 4,589,575 show spring loaded pill dispensers. Atop these dispensers is a cap which either swings or is removable to dispense pills. A disadvantage with these dispensers is the tendency of the spring mechanism to allow unwanted pills to pop out.

In U.S. Pat. No. 4,129,228 a pill container consists of two threaded pieces. An eyelet on one piece allows the container to be worn around the user's neck. The pills are free to move and are prone to colliding and breaking.

U.S. Pat. No. 2,294,001 shows a tablet dispenser with a pocket clip, having a threaded plunger rotatably mounted on a coupling. The plunger dispenses a tablet when the coupling is rotated. Reloading this dispenser is time consuming as the plunger must be retracted by rotating the coupling in the opposite direction. Because of the loose fit of the pills, the pills may rattle, cock and break apart during transportation.

U.S. Pat. Nos. 2,935,180 and 3,612,348 both disclose tablet dispensers employing a ratcheting mechanism. Both of these dispensers are difficult to reload as they are not easily opened.

U.S. Pat. No. 567,488 shows a vial containing a stack of tablets overlaid with a spring and sealed with a cork. This device is difficult to manage as the spring is attached to the cork and fully extends when removed from the vial.

U.S. Pat. Nos. 4,420,076 and 4,756,407 show pill containers closed by a plug or cap having an eyelet. However, the pills can rattle since there is no mechanism to secure them inside the container. See also U.S. Pat. Nos. 3,095,085; 3,306,493; 3,762,539; and 4,166,537.

Thus, there remains a need for a pick up device which is suitable for use by people with limited hand or finger dexterity and which will allow the person to pick up relatively small objects. The device is desirably hand-held and operable with limited finger movements by the person using the device.

SUMMARY OF THE INVENTION

It remained for the present inventor to recognize that an apparatus could be devised with particular embodiments to enable an uncomplicated, efficient method of picking up, holding and dispensing of objects of many sizes. This specification discloses such an apparatus comprising a storing device, a holding device, a retaining device and a pushing device. The storing device is capable of storing a plurality of objects, wherein the objects are of a similar geometric shape and size, with the plurality having a first object, wherein the first object is an object which is placed into the storage device before other objects of the plurality are placed into the storage device, the storing device having a wall, a first end through which the first object can enter the storing device, a second end and a storage volume defined by the volume surrounded by the wall, the first end and the second end, and the storage volume is large enough to store the plurality of objects, the storing device also has a holding device, wherein the object is one object of the plurality, and the holding device is at the first end of the storing device.

The holding device disclosed in this specification provides a holding force on a held object, wherein the held object is one object of the plurality, wherein the holding force has a component that opposes the force of gravity on the held object and the component of the holding force opposing the force of gravity on the held object plus all the other forces on the objects in the storage device that oppose the force of gravity is greater than the force of gravity on all the objects in the storing device so as to keep the held object inside the holding device.

The retaining device disclosed in this specification provides a retaining force on the first object, the retaining force is placed on the first object in the storage device, the retaining force having a component which is not parallel to the holding force; and The ejection device disclosed in this specification provides a ejection force on the first object in the storage device, the ejection force is not parallel to the holding force, and the ejection force is greater than the holding force.

Still another feature of the apparatus includes a tension device for providing a tension force, wherein the tension device applies the tension force to the retaining device; the tension force controls travel of the retaining device by not being perpendicular to the holding force and greater than the force of gravity upon tension device.

Still another feature of the apparatus includes an apparatus, wherein a portion of the storage device is transparent, wherein the holding device is a plastic tip wherein the opening of the holding device is smaller than the at least one object and the holding device has at least one relief slit cut that permits the side of the holding device to flex and create the holding force on the at least one object when the at least one object is pushed into the holding device, wherein the retaining device is a push rod, wherein the push rod is of a sufficient length to traverse the length of the storage device and, the ejection device is a trigger mechanism, wherein the trigger mechanism comprises the elements of a first spring, a first spring stop, a trigger stop and a trigger, wherein mechanism is assembled around the outside of the push rod with the first spring stop is attached to and part of the storage device, the first spring surrounding the push rod with one end of the first spring touching the first stop and the other end of the first spring touching the trigger, wherein the trigger is a flat plate having a first side and a second side and an opening from the first side to the second side, wherein the opening is slightly larger than the push rod and smaller than the smallest opening of the first spring and the push rod passes through the opening and the first side of the trigger touches the other end of the first spring, the second side of the trigger touches one end of the tension device, and the trigger stop is located between the first side of the trigger and a point selected from the group consisting of the other end of the storage device and any point between the other end of the storage device and 0.1 mil from the first side of the trigger.

Still another feature of the apparatus includes an apparatus, wherein the device is a magazine.

Still another feature of the apparatus includes an apparatus, wherein the holding device is a slightly tapered resilient element.

DETAILED DESCRIPTION OF THE DRAWINGS

Figure 1:
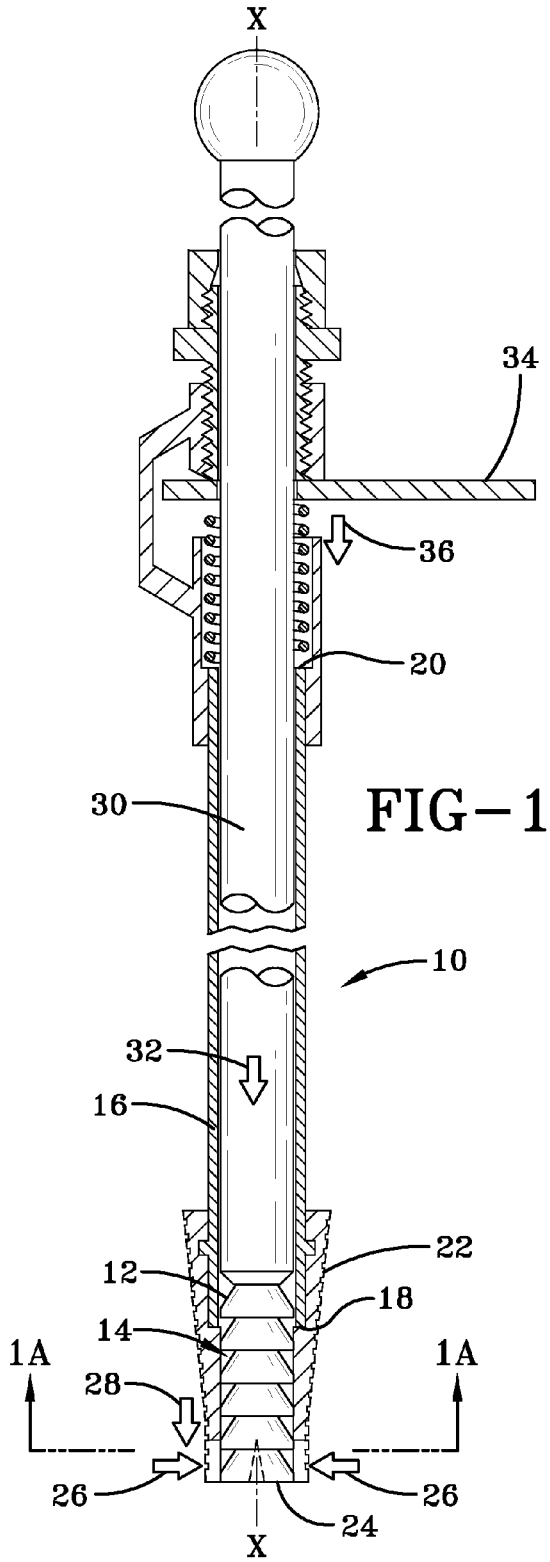
FIG. 1 depicts an enlarged view of the objects and forces at play within the pick up, holding and dispensing device embodying the principles of the invention.
Figure 1A:
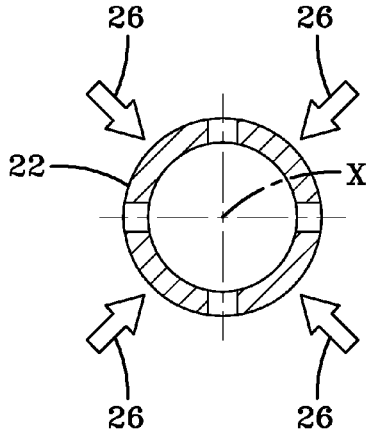

Turning now to the drawings, wherein like components are designated by like reference numerals in the various figures, attention is first directed to FIG. 1 which embodies the principles of the present invention that enables a user to pick up, hold and dispense an object or objects more readily than the known prior art. The apparatus of FIG. 1 depicts a device for picking up, holding and dispensing objects comprising a storing device comprising a magazine or cartridge 10 and an attached holding device 22 capable of storing a plurality of objects 14, the objects being of a similar geometric shape and size, with the plurality having at least a first object 12, the first object is the object which is placed into the storage device (magazine or cartridge 10 and attached holding device 22) before other objects of the plurality 14 are placed into the storage device (magazine or cartridge 10 and attached holding device 22), the storing device having a wall made up of the wall 16 of the magazine or cartridge 10 and the wall of the holding device 22. The storage device has a first end at 50 (see FIG. 2) through which the first object 12 can enter the storing device (magazine or cartridge 10 and attached holding device 22), a second end 20 and a storage volume defined by the volume surrounded by the wall 16 of magazine or cartridge 10 and the wall of the holding device, the first end 50 and the second end 20, and the storage volume is large enough to store the plurality of objects.

There is a holding device 22 providing a holding force 26 on a held object 24, and the held object is one object of the plurality of objects. If the held object is the first object of the plurality placed into the holding device then that held object is the at least one first object. The holding force 26 has at least one component that is not parallel with the force of gravity 28 on the held object and the component of the holding force 26 not parallel with the force of gravity on the held object plus all the other forces, excluding the ejecting force, on the objects in the storage device that oppose the force of gravity is greater than the force of gravity 26 on all the objects in the storing device so as to keep the held object inside the holding device 22.

It is preferred that the inside of the holding means be slightly tapered from the point at 18 to the tip at point 50. The diameter of the holding means should be slightly smaller than the diameter of the objects so that the objects are forced into the holding means causing the holding means to swell and create the holding pressure 26 on the held object 24.

There is also a retaining device 30 for providing a retaining force 32 on the first object 12, the retaining force 32 is placed on the first object 12 in the storage device (magazine or cartridge 10 and attached holding device 22), and the retaining force 32 has a component which is not parallel to the holding force 26. The retaining device, or push rod in the current embodiment, may be tapered at the bottom end of the retaining device or push rod (the end opposite the stopping piece 54 in FIG. 2) to keep the tip of the holding device from unduly deforming or flexing and releasing any objects.

There is an ejection device 30 for providing an ejection force 36 on the first object 12 in the storage device 10, the ejection force 36 is not parallel to the holding force 26, and the ejection force 36, when applied, is greater than the holding force 26. Note that the retaining device and ejection device are one and the same device in the present embodiment. In the present embodiment, the retaining device becomes the ejection device when the trigger mechanism is activated. In another embodiment, the two devices are separate.

All the aforementioned forces of the apparatus are positive forces in that each force is not created by a vacuum. Furthermore, a component of a force is defined as a force which, acting conjointly with one or more forces, produces the effect of a single force or resultant; one of a number of forces into which a single force may be resolved.

Figure 2:
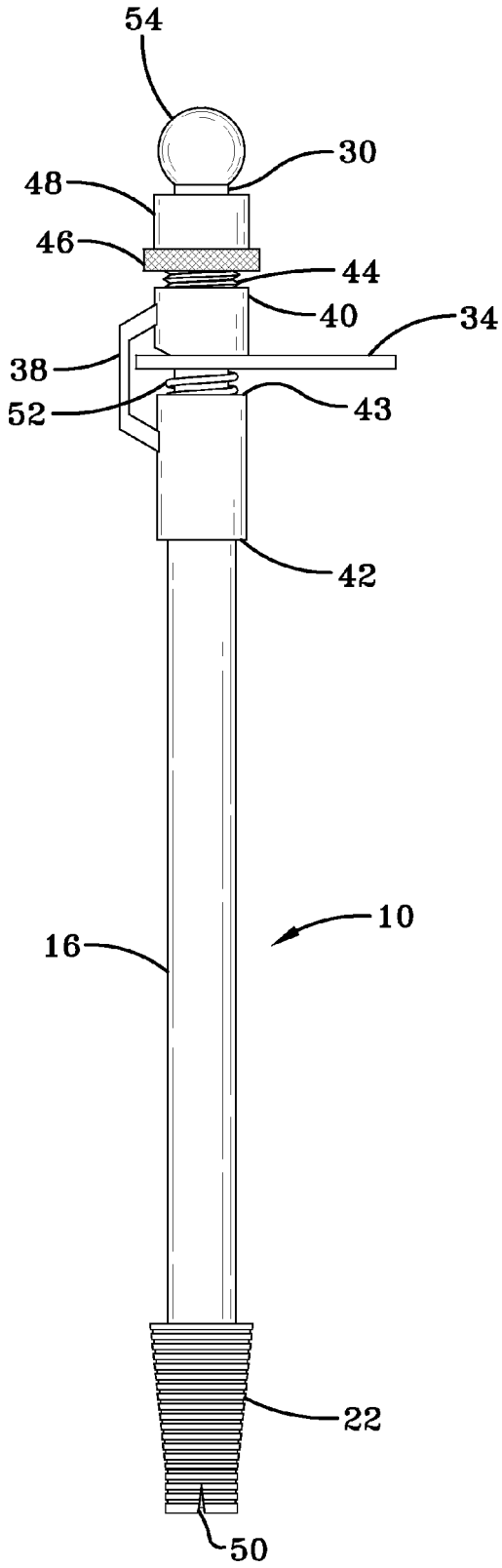
FIG. 2 depicts a pick-up, holding and dispensing device embodying the principles of the invention.

FIG. 2 depicts a pick-up, holding and dispensing device embodying the principles of the invention with additional features including a tension device made up of several parts that together control the level of drag on the retaining device 30. Examples of parts included within the tension device are a restraining body 38, a spring 52, a threaded adjusting collar 44 with an attached fixed knob 46, and a threaded cap 48 for fine adjusting of the tension device. The tension device may be made up of an upper section 40, and a lower section 42. To control the level of drag on the retaining device 30, the cap 48 is adjusted by a screw mechanism on the threaded adjusting collar 44. There may be a stopping piece 54 attached at the end of the retaining device 30 that butts up against the cap 48 when the last object has been dispensed. The shape and size of the stopping piece 54 may take on any configuration, including round, eliptical or tapered configurations.

Figure 3A:
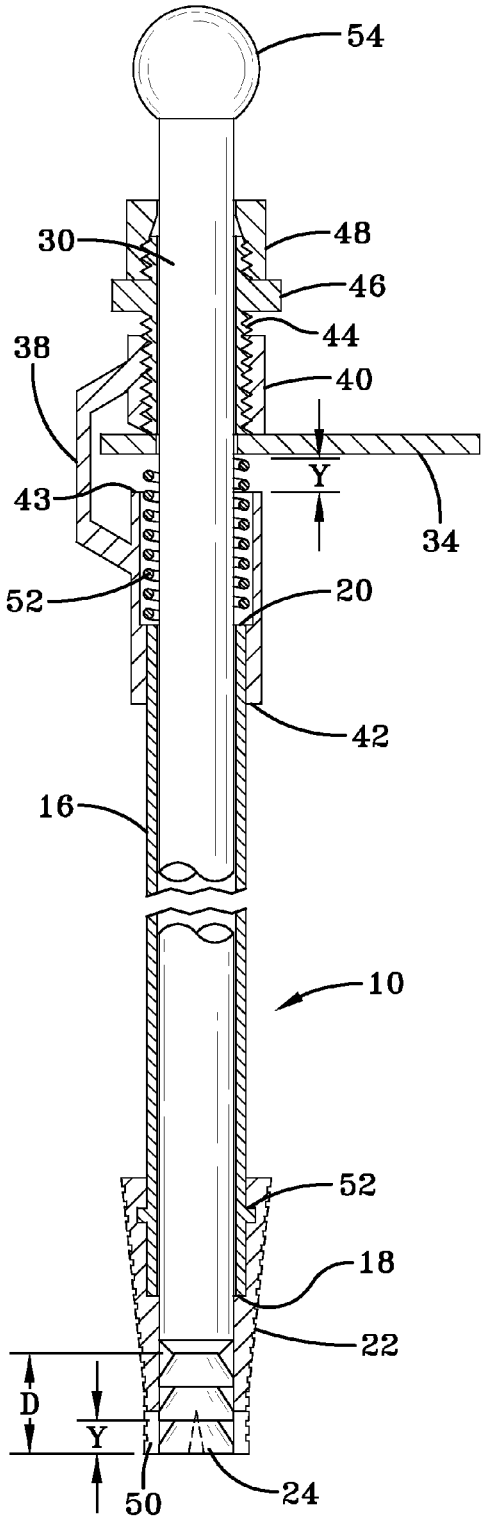
FIG. 3A depicts an internal view of the pick-up, holding and dispensing device of the present invention with objects loaded into the storage device.

In accordance with one embodiment of the invention, FIG. 3A shows a plurality of objects held in the storage device or storage device 10. Further, the Figure shows that the ejection force provided by the ejection device 30 is created by a trigger mechanism. In this embodiment the trigger mechanism is comprised of a first spring 52, a first spring stop 20, a trigger stop 42 and a trigger 34. The trigger mechanism is assembled around the outside of the retaining device or ejection device 30 with the first spring stop 20 attached to the storage device (magazine or cartridge 10 and attached holding device 22). As noted at point 20, the storage device is part of the first spring stop 20. The first spring 52 surrounds the retaining device or ejection device 30 with one end of the first spring touching the first stop 20 and the other end of the first spring touching the trigger 34. The trigger 34 is a flat plate having a first side and a second side and an opening passing from the first side to the second side. Although the present embodiment calls for a flat plate, other embodiments have other shapes, configurations, textures and surfaces of the plate, including but not limited to, rounded, bumpy and ribbed configurations, surfaces and textures. The opening on the trigger plate 34 is slightly larger than the retaining device or ejection device 30 and smaller than the smallest opening of the first spring 52. The length of the retaining device or ejection device 30 passes through the opening and the first side of the trigger touches the other end of the first spring 52. The distance between the trigger 34 and the trigger stop 43 is Y, which is approximately equivalent to the length of the object.

Figure 3B:
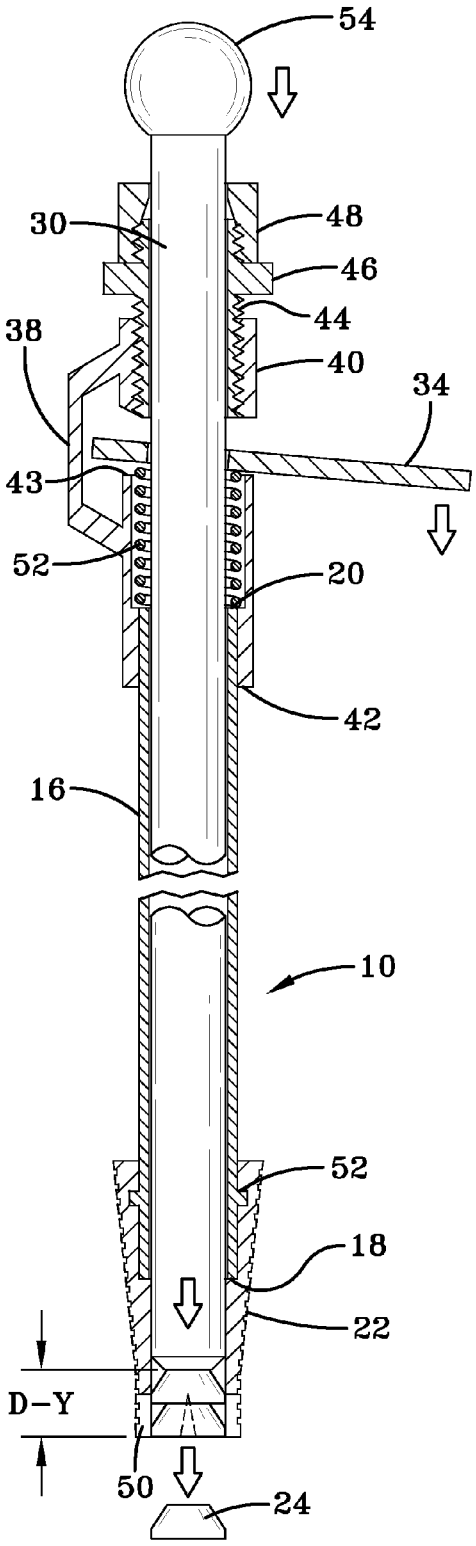
FIG. 3B depicts an internal view of the pick-up, holing and dispensing device of the present invention showing an objected being dispensed from the storage device.

In accordance with one embodiment of the invention, FIG. 3B shows the apparatus after dispensing an object. When the trigger mechanism is activated by pushing in the direction of the holding device, the trigger 34 travels to the trigger stop 43. The distance that the trigger 34 travels Y, is approximately equivalent to the height of the object. Because the hole of trigger 34 locks onto ejection device 30, ejection device 30 travels approximately distance Y creating the ejecting force on object 12 for a sufficient distance to eject just one object past the holding device and out of the storage device. To control the amount of travel Y of the trigger 34, which subsequently determines the amount of distance traveled by the ejection device 30, the knob 46 attached to the threaded adjusting collar 44 may be rotated so as to drive the increase or decrease the distance between 40 and the trigger 34. By changing the distance between 40 and trigger 34, the distance Y is changed in the opposite way. Note that the notch on the back side of 40 may enable the lever 34 to grab higher on the push rod 30 before traveling the distance Y. This "grab distance" is represented in FIG. 3B just below the lever 34 and just above the distance depicted as Y.

Figure 4:
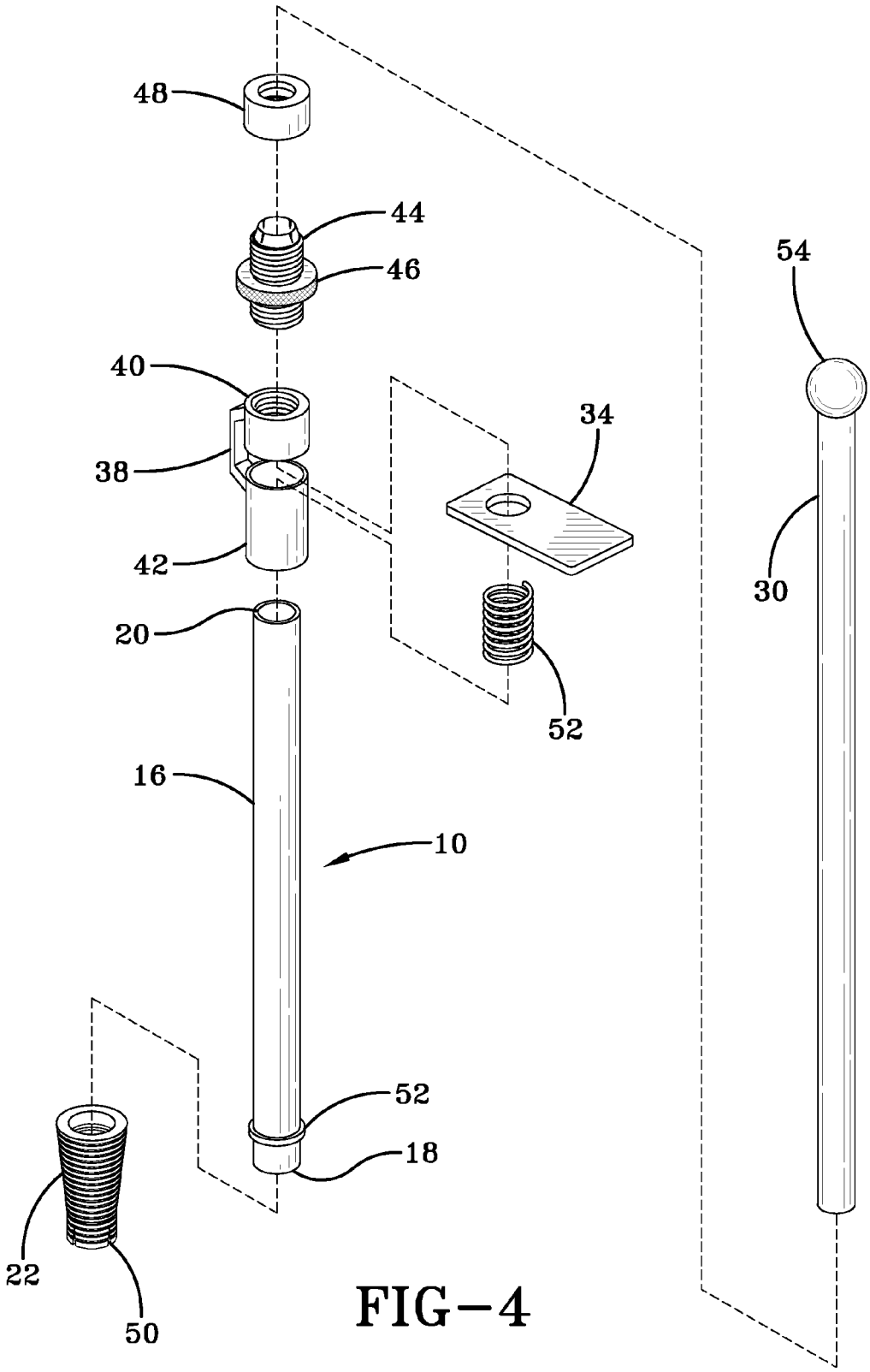
FIG. 4 depicts an exploded view of the individual parts within the pick-up, holding and dispensing device.

FIG. 4 depicts an exploded view of the individual parts within the pick-up, holding and dispensing device. In the holding device or tip 22, there are slits at 50 for grabbing and holding a slightly larger sized object. The term slit in the current embodiment includes any kind of modification made to the holding device, including but not limited to, slots, notches or cuts. The tip or holding device 22 are available in different configurations to accommodate different sizes and shapes of objects 14. Similarly, the configuration of the slit may vary to accommodate different sizes and shapes of objects. For example, the width of the slit may increase to accommodate a particular object. The tip or holding device 22 may be made from any deformable material. In one embodiment, the tip is constructed of a polymeric material. There may be a lip 52 on the outer circumference of said storage device 10 to allow a snug connection with the tip 22.

In one embodiment, at least a portion of the magazine or cartridge 10 and tension device is transparent so as to permit one to determine the fill level of the magazine or cartridge. Examples of suitable plastics with which to make the magazine or cartridge 10 or tension device include polypropylenes, polyethylenes or thermoplastic polyethylenes.

The aforementioned apparatus can be used to pick up, hold and dispense objects from a variety of different industries. For example, the apparatus could be used to pick up, hold and dispense objects including, but not limited to, crystals, nuts, confectionary pieces, pills, jewelry, and electronic components. In one embodiment of the invention, the apparatus is used to pick up crystals. The pick up and placement of crystals is an extremely tedious process requiring excellent dexterity, time and patience on the part of the user. The present invention would provide a significant improvement over state of the art apparatuses such as tweezers which are currently on the market for picking up and placing such items. There are several sizes and shapes of crystals on the market, and the apparatus is devised to accommodate the particular shape and size of interest. For example, the tips can come in a variety of different sizes to accommodate the particular size and shape of crystal. The following are different sizes of crystals that could be accommodated by the apparatus of the present invention:

| Sizes |
|---|
| 5ss - (1.7 to 1.9 mm) |
| 7ss - (2.1 to 2.3 mm) |
| 9ss - (2.5 to 2.7 mm) |
| 10ss - (2.7 to 2.9 mm) |
| 12ss - (3.0 to 3.2 mm) |
| 16ss - (3.8 to 4.0 mm) |
| 20ss - (4.6 to 4.8 mm) |
| 30ss - (6.32 to 6.50 mm) |
| 34ss - (7.07 to 7.27 mm) |
| 40ss - (8.41 to 8.67 mm) |
| 48ss - (10.91 to 11.30 mm) |

The aforementioned crystal sizes are only examples, and are by no means the only sizes that could be used within the apparatus. In fact, it is well known within the crystal industry, that there are several types of sizes available. See http://www.preciosa.com/preciosa/en/stones/products/basic/conversion-table.htm and www/swarovski.com for more information on crystal sizes.

In accordance with another embodiment of the invention, there may be different materials used to construct the tips as well as different configurations of the tips. For example, the notched tip could be constructed of a rigid plastic with a flexible, "rubber like" material wrapped around the more rigid plastic enabling the necessary flex to grab and hold an object. Alternatively, there could be a configuration involving pivot points paired with rubber like cushions. The pivot points may flex to accommodate the object for pick-up.

In addition, the size of the storage device could vary to accommodate the different size crystals previously mentioned. For example, one storage device could accommodate crystal sizes 5SS-9SS, another storage device could accommodate crystal sizes 10SS-16SS, another storage device could accommodate crystal sizes 20SS-34SS, and still another storage device could accommodate crystal sizes 40SS-48SS. These are just examples of the types of size differences that could exist to accommodate the various crystal sizes. In actuality, the size of the storage device is not limited to these sizes and instead could accommodate fractional SS crystal size differences, or any increment of whole number SS crystal size differences.

In accordance with another embodiment of the invention, the apparatus could be used to pick up pills from a flat surface. People with unsteady hands or limited control of their fingers often encounter significant difficulties in gripping small objects with their fingers, such as picking up a pill or a paper clip with their finger tips. Similar difficulties are experienced by people who have restricted mobility of their fingers caused by symptomatic joints, such as inflammation, arthritis, or the like. For those people with limited hand/finger dexterity, a hand-held gripping device that allows the person to pick up small objects with relative ease is clearly desirable and the apparatus of the present invention addresses this need.

In accordance with another embodiment of the invention, the apparatus could be used as an ingenious way of administering pills and capsules to animals. Various devices have previously been recognized and pill guns of various sorts have been devised. However, taking into consideration that the person who is administering the pills or capsules must also use his other hand to hold the animal's mouth open and hold its head in the proper position, such prior devices have been uniformly deficient in their construction which does not permit careful and precise manipulation of the tool so that the pill gun can be quickly inserted into the animal's mouth at the opportune moment.

In accordance with another embodiment of the invention, the objects would be gravity fed down the storage device, one object at a time. In this apparatus, pulling a trigger would cause a gate to spring open thereby releasing one object. If the object falls upside down, a flipper would flip the object over.

In accordance with another embodiment of the invention, the objects are organized in a revolver with impressions shaped to the geometric size and shape of the object. As the revolver turns, only objects of a certain size and shape can fit into particular impressions.

In accordance with another embodiment of the invention, the holding device is made with a deformable material to accommodate picking up an object. The holding device may further be notched to allow the material to flex to accommodate an object. In one embodiment, the holding device is approximately 3/64 inch (1.19 mm) smaller than the object diameter. By adding four relief notches of approximately 5/32 inch (3.9865 mm) in height, the object is picked up and held within the apparatus. The holding forces on the object prevent movement and in fact, keep the object stacked within the storing device in order. In other embodiments, the holding device is not limited to this size difference with the crystal. Similarly, in other embodiments, the relief notches are not limited to this height.

In one embodiment of the invention, the storage device is 1/64 inch larger than the size of the object. In other embodiments, the size difference between the storage device and the size of the object is not limited to the aforementioned size difference. By using a storage device closer in size to the object, the objects stack up and remain within the storage device. The storage device may be made of any material including ceramic, plastic or metal. In one embodiment of the invention, the storage device is transparent to enable check on color and supply of object.

In accordance with another embodiment of the invention, a ratchet drive is incorporated onto the outer circumference of the storage device. As a trigger on the ratchet drive is pulled back, one notch at a time, one object would be dispensed at a time. The distance between each notch on the apparatus would be equivalent to the height of the object.

In accordance with another embodiment of the invention, a screw drive is incorporated within the storage device. A trigger is pulled to drive the screw. As the screw turns, the retaining device would travel and dispense one object. A rear gear on the screw drive turns the screw one way and free wheels the other way.

The device may be constructed of any suitable material, including but not limited to, plastic, ceramic and metals. This particular embodiment may also be sold as a kit. The contents of the kit including, but not limited to, the storage device, the holding device, the retaining device and may include a replacement or spare holding device for replacing a worn holding device, or a different size holding device to accommodate a different size object. The kit may also include replacement or spare objects or storage device. The objects may be preloaded within the storage device. The objects preloaded within the storage device together with the storage device may be considered cartridges or magazines. The cartridges may be included within the kit. Alternatively, the holding device, storage device, objects and any potential cartridges, may be sold alone as replacement parts. All of the features of this embodiment are assembled in such as way as to provide several options to the consumer to quickly and economically pick up objects into the device, or conversely, dispense objects from the device.

It thus will be appreciated that those skilled in the art will be able to devise numerous alternative arrangements that, while not shown or described herein, embody the principles of the invention and thus are within its spirit and scope. This application is not limited to the storage device, holding device, retaining device, ejection device and tension device, and their individual components, as described, but also to their equivalents.

We claim:

1. An apparatus, comprising:

a storage device capable of storing a plurality of objects, wherein the objects are of a similar geometric shape and size, said storage device having a wall, a first end through which a first object can enter said storage device, a second end and a storage volume defined by the volume surrounded by the wall, the first end and the second end, and the storage volume is large enough to store the plurality of objects, wherein said storage device comprises a holding device having a tip made from a deformable material located at the first end of the storage device, providing a holding force on a held object, wherein the held object is one object of the plurality, wherein the holding force has a component that opposes the force of gravity on the held object so as to keep the held object inside the holding device;

a retaining device for providing a retaining force on a first object of the plurality of objects, wherein the first object of the plurality is an object of the plurality which is placed into the storage device before other objects of the plurality are placed into the storage device, the retaining force having a component which is not parallel to the holding force;

an ejection device for providing an ejection force on the first object in the storage device, said ejection force is not parallel to the holding force, and said ejection force is greater than said holding force, wherein the retaining device is a push rod; wherein the push rod is of a sufficient length to traverse the length of the storage device; and wherein the ejection device is a trigger mechanism, wherein the trigger mechanism comprises the elements of a first spring, a first spring stop, a trigger stop and a trigger, wherein the trigger mechanism is assembled around the outside of the push rod with the first spring stop attached to and part of the storage device, the first spring surrounding the push rod with one end of the first spring touching the first spring stop and the other end of the first spring touching the trigger, wherein the trigger has a first side and a second side and an opening from the first side to the second side, wherein the opening is slightly larger than the push rod and smaller than the smallest opening of the first spring and the push rod passes through the opening and the first side of the trigger touches the other end of the first spring, the second side of the trigger touches one end of a tension device, and the trigger stop is located between the first side of the trigger and a point selected from the group consisting of the second end of the storage device and any point between the second end of the storage device and 0.1 mil from the first side of the trigger.

2. The apparatus of claim 1, wherein the ejection device and retaining device are the same device.

3. An apparatus, comprising:

a storage device capable of storing a plurality of objects, wherein the objects are of a similar geometric shape and size, said storage device having a wall, a first end through which a first object can enter said storage device, a second end and a storage volume defined by the volume surrounded by the wall, the first end and the second end, and the storage volume is large enough to store the plurality of objects;

wherein said storage device comprises a holding device having a tip made from a deformable material located at the first end of the storage device, providing a holding force on a held object, wherein the held object is one object of the plurality, wherein the holding force has a component that opposes the force of gravity on the held object so as to keep the held object inside the holding device;

a retaining device for providing a retaining force on a first object of the plurality of objects, wherein the first object of the plurality is an object of the plurality which is placed into the storage device before other objects of the plurality are placed into the storage device, the retaining force having a component which is not parallel to the holding force;

an ejection device for providing an ejection force on the first object in the storage device, said ejection force is not parallel to the holding force, and said ejection force is greater than said holding force;

a tension device for providing a tension force, wherein the tension device applies the tension force to the retaining device to control a level of drag on the retaining device;

wherein the retaining device is a push rod; wherein the push rod is of a sufficient length to traverse the length of the storage device; and wherein the ejection device is a trigger mechanism, wherein the trigger mechanism comprises the elements of a first spring, a first spring stop, a trigger stop and a trigger, wherein the trigger mechanism is assembled around the outside of the push rod with the first spring stop is attached to and part of the storage device, the first spring surrounding the push rod with one end of the first spring touching the first spring stop and the other end of the first spring touching the trigger, wherein the trigger has a first side and a second side and an opening from the first side to the second side, wherein the opening is slightly larger than the push rod and the push rod passes through the opening and the first side of the trigger touches the other end of the first spring, the second side of the trigger touches one end of the tension device, and the trigger stop is located between the first side of the trigger and a point selected from the group consisting of the second end of the storage device and any point between the second end of the storage device and 0.1 mil from the first side of the trigger.

4. The apparatus of claim 3, wherein the ejection device and the retaining device are the same device.

5. The apparatus of claim 3, wherein a portion of the storage device is transparent.

6. The apparatus of claim 5, wherein the holding device has at least one relief slit that permits the side of the holding device to flex and create the holding force on the first object when the first object is pushed into the holding device.

7. The apparatus of claim 5, wherein the deformable material of the holding device is a plastic.

8. The apparatus of claim 7, wherein a portion of the storage device is transparent.

9. An apparatus, comprising:

a storage device capable of storing a plurality of objects, wherein the objects are of a similar geometric shape and size, said storage device having a wall, a first end through which a first object can enter said storage device, a second end and a storage volume defined by the volume surrounded by the wall, the first end and the second end, and the storage volume is large enough to store the plurality of objects, wherein said storage device comprises a holding device having a tip made from a deformable material located at the first end of the storage device, providing a holding force on a held object, wherein the held object is one object of the plurality, wherein the holding force has a component that opposes the force of gravity on the held object so as to keep the held object inside the holding device;

a retaining device for providing a retaining force on a first object of the plurality of objects, wherein the first object of the plurality is an object of the plurality which is placed into the storage device before other objects of the plurality are placed into the storage device, the retaining force having a component which is not parallel to the holding force;

an ejection device for providing an ejection force on the first object in the storage device, said ejection force is not parallel to the holding force, and said ejection force is greater than said holding force;

wherein the deformable material of the holding device is plastic, and wherein the retaining device is a push rod; wherein the push rod is of a sufficient length to traverse the length of the storage device; and wherein the ejection device is a trigger mechanism, wherein the trigger mechanism comprises the elements of a first spring, a first spring stop, a trigger stop and a trigger, wherein the trigger mechanism is assembled around the outside of the push rod with the first spring stop attached to and part of the storage device, the first spring surrounding the push rod with one end of the first spring touching the first spring stop and the other end of the first spring touching the trigger, wherein the trigger has a first side and a second side and an opening from the first side to the second side, wherein the opening is slightly larger than the push rod and smaller than the smallest opening of the first spring and the push rod passes through the opening and the first side of the trigger touches the other end of the first spring, the second side of the trigger touches one end of a tension device, and the trigger stop is located between the first side of the trigger and a point selected from the group consisting of the second end of the storage device and any point between the second end of the storage device and 0.1 mil from the first side of the trigger.

10. The apparatus of claim 9, wherein a portion of the storage device is transparent.

11. The apparatus of claim 9, wherein the holding device has at least one relief slit that permits the side of the holding device to flex and create the holding force on the first object when the first object is pushed into the holding device.

12. The apparatus of claim 11, wherein the ejection device and the retaining device are the same device.

13. The apparatus of claim 11, wherein a portion of the storage device is transparent.

14. The apparatus of claim 9, wherein the ejection device and retaining device are the same device.

* * * * *